United States Patent [19]

Holladay

[11] 4,288,010

[45] Sep. 8, 1981

[54] EMBROIDERY THREAD ORGANIZER

[75] Inventor: Joseph W. Holladay, Eatontown, N.J.

[73] Assignee: Jo-Pat, Incorporated, Nashville, Tenn.

[21] Appl. No.: 77,631

[22] Filed: Sep. 21, 1979

[51] Int. Cl.[3] ..... A41H 31/00

[52] U.S. Cl. ..... 223/106

[58] Field of Search ..... 223/106, 107

[56] References Cited

U.S. PATENT DOCUMENTS

| | | | |
|---|---|---|---|
| 142,073 | 8/1873 | Bates . | |
| 1,081,070 | 12/1913 | Walters | 223/106 X |
| 2,103,571 | 12/1937 | Watson | 223/106 |
| 4,029,241 | 6/1977 | Krake | 223/106 |

*Primary Examiner*—Louis Rimrodt

*Attorney, Agent, or Firm*—Brady, O'Boyle & Gates

[57] ABSTRACT

Disclosed is a space saving means for accepting and retaining plural lengths of threads or yarns which have been transferred thereto from respective skeins. The subject invention is comprised of a plurality of nestable cylindrical tubes, each having a number of spaced outwardly projecting annular divider members or ribs which define segregated spool portions which are adapted to accept and retain, without entanglement, respective windings of thread or yarns for later use on a selective basis. The nested tubes are preferably made of clear plastic to enable the user to see the color of the threads available and a tubular plastic case is also included to house the nested cylinders when not in use and thus protect the thread windings from dust and dirt.

6 Claims, 3 Drawing Figures

EMBROIDERY THREAD ORGANIZER

BACKGROUND OF THE INVENTION

This invention relates to means for storing and dispensing embroidery thread or the like and more particularly to a nested configuration of spool type elements, each of which are adapted to accept and segregate a plurality of windings of various sizes and colors.

It is common practice for a user for embroidery thread, for example, to purchase various types and colors of threads which have first been wound into skeins. To facilitate use of the various embroidery threads, they are generally unwound from the respective skeins and thereafter stored for example in a sewing basket until a particular embroidery thread is required. Needless to say, that entanglement of the various threads poses a problem and considerable irritation to the user.

It is an object of the present invention, therefore, to provide a device that is adapted to store thread or yarn in an efficient manner while removing the possibility of entanglement.

It is another object of the present invention to provide a device for protecting lengths of thread or yarn from dust and dirt.

SUMMARY

Briefly, the subject invention is directed to an improvement in means for storing and dispensing the yarns or threads of various thicknesses, colors and designs and comprises a plurality of clear preferably cylindrical tubes of graduated sizes so that they are adapted to be nested inside of one another. Each cylindrical tube includes on its outer suface a plurality of spaced annular dividers which define respective spool portions adapted to accept and retain individual lengths of thread or yarn which have been transferred thereto from skeins. The outer surfaces of the tubes are additionally roughened to provide a frictional surface for the threads and yarns to keep them from slipping around the tubes. The nested members are adapted to be selectively removed for the use in dispensing selected threads or yarns but nested in a telescoping arrangement during storage. Additionally, a cylindrical casing is provided when desired to accept one or more of the nested members so as to protect the threads or yarns wound thereon from dust and dirt.

DESCRIPTION OF THE PREFERRED EMBODIMENT

Figure 1:
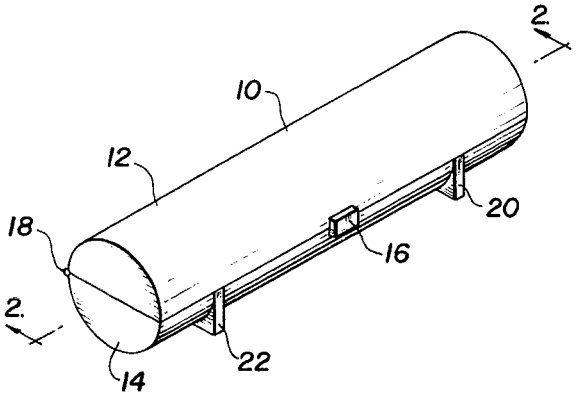
FIG. 1 is a perspective view of a generally tubular storage container adapted for use in connection with the subject invention.

Referring now to the drawings wherein like numerals refer to like parts throughout, reference is first made to FIG. 1 wherein reference numeral 10 designates a generally cylindrical container or casing which is divided into upper and lower halves 12 and 14. The two halves are adapted to fit together and held closed by a closure member 16. The halves 12 and 14 may be configured to have a press fit or can be hinged along the rear edge by means of a hinge element 18. Additionally, the casing is adapted to have a pair of leg members 20 and 22 fastened to the lower half 14 so as to provide a suitable platform for being positioned on a support surface, not shown. The casing 10 is preferably comprised of clear plastic material; however, when desirable it may be fabricated from any desirable light weight material and of any desirable color.

Figure 3:
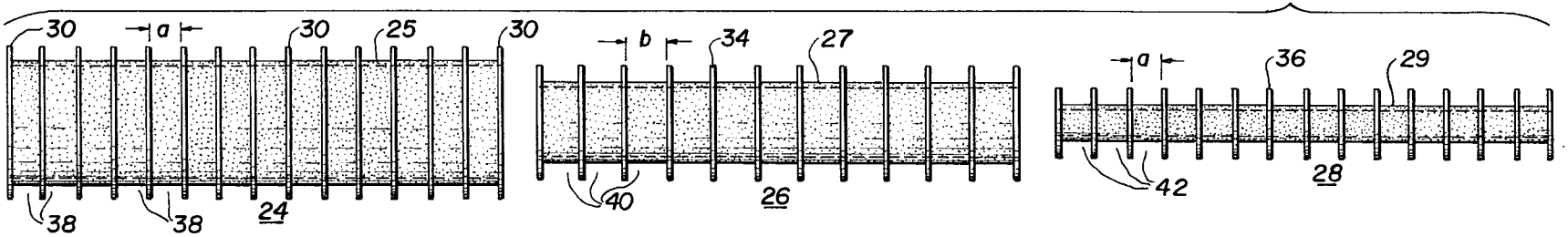
FIG. 3 is a diagram illustrative of the relative size of the component parts shown in FIG. 2 when separated from one another.
Figure 2:
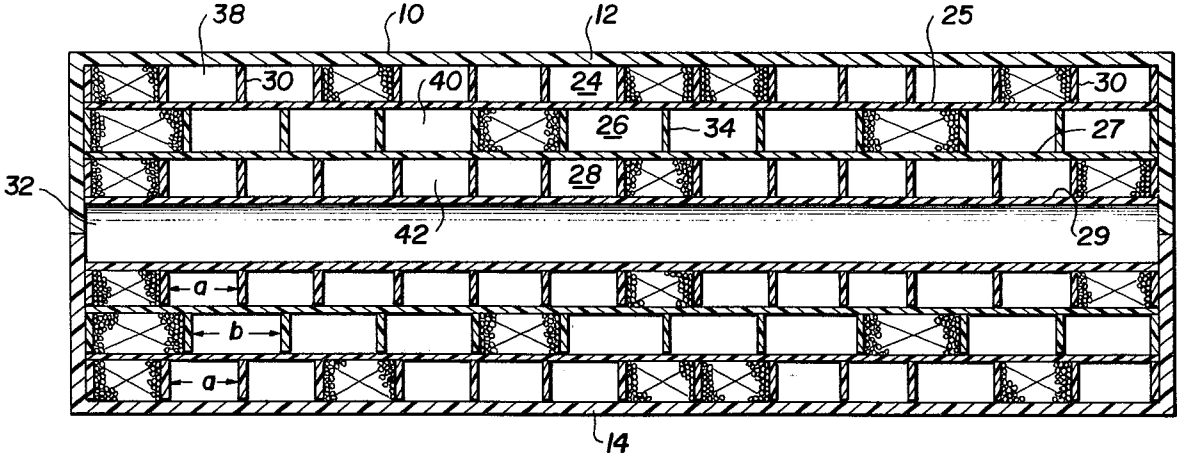
FIG. 2 is a central longitudinal cross section of the container shown in FIG. 1 taken along the lines 2—2 and additionally illustrating a nested arrangement of thread storage members in the container.

The casing 10 is adapted to store and protect a plurality of nested members 24, 26 and 28 which are individually adapted to accept and dispense thread or yarn from a selected number of plural spool regions defined by multiple separating elements. More particularly, the preferred embodiment of the subject invention shown in FIGS. 2 and 3 comprises three cylindrical tubes 25, 27 and 29 of varying diameters so that as shown in FIG. 2, member 28 is adapted to fit inside of member 26, with both members 28 and 26 being adapted to fit inside the member 24. Each of the tubes 25, 27 and 29 include a plurality of equally spaced annular separators or spacers in the form of outwardly projecting relatively thin flat faced vanes having a generally circular perimeter which thereby define segregated regions on the outer cylinder walls for accepting various types of threads and yarns which are transferred thereto from skeins, not shown. The outer cylindrical walls are also preferably roughened or coated with a substance to provide a frictional surface to keep the threads or yarns from slipping on the tubes. The outermost cylinder 25 includes a plurality of annular separators 30 which have an outer diameter substantially equal to the inner diameter of the inner wall surface 32 of the casing 10 defined by the upper and lower casing halves 12 and 14 as shown in FIG. 2. The intermediate size cylinder 27 includes a plurality of equally spaced annular separators 34 which have an outer diameter selected so that it is adapted to slide freely in and out of the cylinder 25 but sufficient to be supported thereby. The third cylindrical member 29 also includes a plurality of equally spaced annular separators 36 of a sufficient diameter to freely slide in and out of the cylinder 27.

As shown, the distance between the separators 30 and 36 comprises the dimension a, whereas the separators 34 have a mutual separation distance b. As can be seen by reference to FIG. 2, the dimension b is greater than a. Such an arrangement will provide increased structural rigidity when the three members 24, 26 and 28 are in a nested configuration. Three respective sets of segregated spool regions 38, 40 and 42 are provided by the nestable members 24, 26 and 28 so that threads or yarns of various colors, thicknesses and lengths may be wrapped around cylinders between the respective spacers at any desired location. It is evident that a relatively large number of webs or yarns can be accommodated without the possiblity of the various yarns wound thereon becoming entangled with one another. While the subject invention has particular utility with respect to embroidery threads, it should be noted that the dimensions of the components shown can be altered when desirable to accept other types of threads as well as yarns, e.g. knitting yarn and crewel yarn, etc.

In its preferred form, the cylinder members 24, 26 and 28 as well as their respective annular spacers or separators 30, 34 and 36 are comprised of clear plastic so that the various individual windings may be readily identifiable. When desirable, however, colored plastic or other material may be used for other purposes such as decorative purposes.

Moreover, the two outer members 24 and 26 are made large enough so that an entire skein of thread may be wrapped around respective cylinders at each spool region. The lengths of the cylinders determine the number of spool regions and accordingly the number of colors of thread that may be wound on a single cylinder. The smallest cylinder 28 may not accommodate a complete skein at each spool location, however, in any event it can be used to accommodate at least partial skeins.

Thus what has been shown and described is a plurality of nested or telescoping cylindrical tubes each having equally spaced outwardly projecting dividers which are adapted to accept and retain respective windings of thread or yarn which have been transferred thereto from skeins and which therefore provide a means for thereafter dispensing the threads or yarns to the user.

While the subject invention has been shown and described with what is considered to be the preferred embodiment thereof, it should be noted that the foregoing specification is made by way of illustrative example only and is not meant to be intepreted in a limiting sense since alterations in the shape, size and arrangement of components may be resorted to without departing from the spirit and scope of the invention as defined in the appended claims.

I claim:

1. Apparatus for storing and dispensing plural lengths or windings of threads and yarns and the like previously transferred thereto, for example, from respective skeins while preventing entanglement, comprising the combination of:

at least three nestable cylindrical tubes of substantially equal length and varying sizes, each tube being relatively elongated and unitary and having a pair of end members and a plurality of relatively flat faced vanes acting as dividers spaced intermediate said end members, said end members and said vanes being integral with a respective tube to define plural retention regions on each tube for individual winding of said threads and yarns transferred thereto, said end members and said vanes having a generally circular perimeter and selectively dimensioned to slide freely in and out and completely removable from the inner diameter of the next larger sized tube and wherein the spacing between the vanes of the innermost and outermost tubes is substantially the same but the vane spacing of the intermediate tube is relatively greater than the spacing of said innermost and outermost tubes whereby increased structural rigidity is provided, each tube and its respective end members and vanes being comprised of transparent material for providing ease of identification of the various windings transferred thereto and each tube further having a frictional surface on its outer wall to prevent the slipping of said windings thereon.

2. The apparatus as defined by claim 1 wherein said plurality of relatively flat faced vanes are equally spaced on the respective tubes.

3. The apparatus as defined by claim 1 wherein said plurality of relatively flat faced vanes comprises a plurality of annular separators.

4. The apparatus as defined by claim 1 and additionally including a container having an inner storage space adapted to accommodate at least the largest of said plurality of nestable tubes and thereby accommodate all of said nestable tubes when telescoped inside of one another.

5. The apparatus as defined by claim 4 wherein said casing is generally cylindrical in configuration.

6. The apparatus as defined by claim 1 and additionally including a casing of transparent material, said casing being selectively dimensioned to accommodate said plurality of nestable tubes when in a nesting relationship.

* * * * *